US005084931A

United States Patent [19]

Kühlcke

[11] Patent Number: 5,084,931

[45] Date of Patent: Feb. 4, 1992

[54] PAINT BRUSH WITH REPLACEABLE APPLICATOR

[76] Inventor: Reiner J. Kühlcke, Calle 65 No. 5920, 1653 V. Ballester, Argentina

[21] Appl. No.: 339,241

[22] Filed: Apr. 14, 1989

[30] Foreign Application Priority Data

Apr. 25, 1988 [AR] Argentina ..... 310,654

[51] Int. Cl.[5] ..... A47L 13/46

[52] U.S. Cl. ..... 15/244.1; 15/147 C; 15/150; 15/176.6

[58] Field of Search ..... 15/147 R, 147 C, 236.03, 15/244.1, 244.2, 244.4, 150, 210 R, 176.6

[56] References Cited

U.S. PATENT DOCUMENTS

| | | | |
|---|---|---|---|
| 35,951 | 7/1862 | Reed | 15/150 |
| 512,543 | 1/1894 | Froberg | 15/150 |
| 1,535,767 | 4/1925 | Cunningham | 15/150 |
| 1,630,418 | 5/1927 | Ewing | 15/150 |
| 3,457,581 | 7/1969 | Oas | 15/147 R |
| 3,797,062 | 3/1974 | Locicero | 15/244.1 |
| 3,897,603 | 8/1975 | Brennenstuhl | 15/244.1 |
| 4,287,632 | 9/1981 | Hammond | 15/150 |
| 4,493,124 | 1/1985 | Agapiou | 15/244.1 X |

FOREIGN PATENT DOCUMENTS

| | | | |
|---|---|---|---|
| 139873 | 7/1964 | Argentina . | |
| 157549 | 11/1967 | Argentina . | |
| 162198 | 7/1968 | Argentina . | |
| 234401 | 6/1987 | Argentina . | |
| 170012 | 9/1934 | Fed. Rep. of Germany | 15/147 C |

*Primary Examiner*—Harvey C. Hornsby
*Assistant Examiner*—K. O'Leary
*Attorney, Agent, or Firm*—Michael J. Striker

[57] ABSTRACT

The paint brush comprises a handle having a male half and a female half with housing receptacle walls and interior partitions with serrated edges of smaller height than the lateral walls. A projecting member protrudes from the housing receptacle of the female half having a bottom opening next to it. A guide is provided in the female half, and a stem with a hook-like nose on a free end thereof projects from the male half. The replaceable applicator part with at least one retention ringlet is held by support and anchorage device. The male half has guide lugs which cooperate with the guide so that when the handle is closed, the hook-like nose passes by and adjacent the projecting member and through the opening in the female half.

10 Claims, 4 Drawing Sheets

PAINT BRUSH WITH REPLACEABLE APPLICATOR

BACKGROUND OF THE INVENTION

The present invention relates to a brush with an applicator part which, once it has been used, can be replaced by another new one.

The discardable paintbrushes, which are used only once and are then thrown away, thus avoiding the messy job of cleaning them after each time they are used, are already known.

Thus, Argentine Patent No. 139.873 discloses a device for applying paints, varnishes and other coatings, which comprises a handle provided at one of its ends with a semirigid impermeable sheet, bearing on both surfaces a layer of affixed spongy material.

In Argentine Patent No. 157.549, additional to the foregoing, the sheet of semirigid impermeable material is a flat bar slightly narrower than the end of the handle holding it, and the layer of spongy material rests on the flat bar; the layer is constituted by a body having a rectangular area, in one of whose smaller bases there is an open insertion groove for the flat bar, whereas the opposite base gives rise to an area shaped as a triangular prism.

In Argentine Patent No. 162.198, also additional to the first one, the handle is formed by sheet metal folded upon itself along one of its center lines, determining a pair of superposed areas, each of which present a portion of a segment folded towards the other area and in reciprocal contact at its edges, forming a hollow head and in their interior a housing shaped as a dihedron in which the layer of spongy material is placed under pressure.

Finally, Argentine Patent No. 234,401 proposes a discartable paint brush, constituted by an applicator part of absorbent material, integrally adhered to a lug of elastomeric material protruding from the handle.

The objective of the above mentioned patents is to increase the durability of the discardable paint brush.

THE SUMMARY OF THE INVENTION

Accordingly, it is an object of my invention to provide a paint brush with a discardable applicator and a handle, which fulfills the objectives of the above-described distractible paint brushes.

In keeping with this object and with others which will become apparent hereinafter, the paint brush comprises.

A new paint brush has been invented now, the applicator part of which, once used, can be substituted by a new one, thus fulfilling the objective of the discardable paint brushes of avoiding cleaning them after use.

A replaceable applicator part comprising a prismatic body of foam material or a packet of bristles having one or two retention ringlets on the side which is introduced in the handle. On the other hand, the handle is formed by two longitudinal halves which are hinged at the opposite end to that holding the applicator part. These longitudinal halves differ from one another by their interior shape, by which one can be considered male and the other female. That appearance of the assembled paint brush is similar to that of a conventional paint brush.

In their interior, both halves have corresponding receptacles to house the secured end of the applicator part which, at the front side, have a partition slightly lower than the lateral walls, ending in a serrated edge engaging the secured end of the applicator part when the handle is closed. Besides, support and anchoring means for the retention ringlets have been provided.

A projecting member advantageously an incomplete prism, without bases and closed only by three sides, is provided on the female half of the handle, which constitutes a prolongation inwards of an opening in the bottom of the receptacle.

In its lateral walls, this female half has corresponding guide means, perpendicular to its bottom. The other half, which we call male, in correspondence with the incomplete prism of the female half, has a stem which rises prependicularly from the bottom of the receptacle, having at its free end a hook-like nose which, when the handle is closed, passes adjacent the projecting member or incomplete prism and through the opening in the female half and hooks on to the outer surface thereof, preventing the handle from opening. To open the handle, the emerging part of the stem is pushed forward, so that its nose departs from the outer surface and between the hole, thus releasing it. The male half further has, and also in correspondence with the guides of the female half, guide lugs protruding internally on both sides of the receptacle and which, when the handle is closed, fit in said guides.

BRIEF DESCRIPTION OF THE DRAWINGS

The objects, features and advantages of my invention will be made more apparent from the following detailed description, reference being made to the accompanying drawing in which:

The drawings illustrate preferred realizations of the invention:

FIG. 1 shows a first embodiment with the applicator part 1, changeable, constituted in this example by a prismatic body 1' of foam material, in a position ready to be placed within handle 2, formed by two halves 2' and 2'' joined by means of hinges 3. The prismatic body 1' has a flat insert 4 shape like a wedge, which is inserted into the prismatic body 1' and extends from it the retention ringlet 5.

Figure 2:
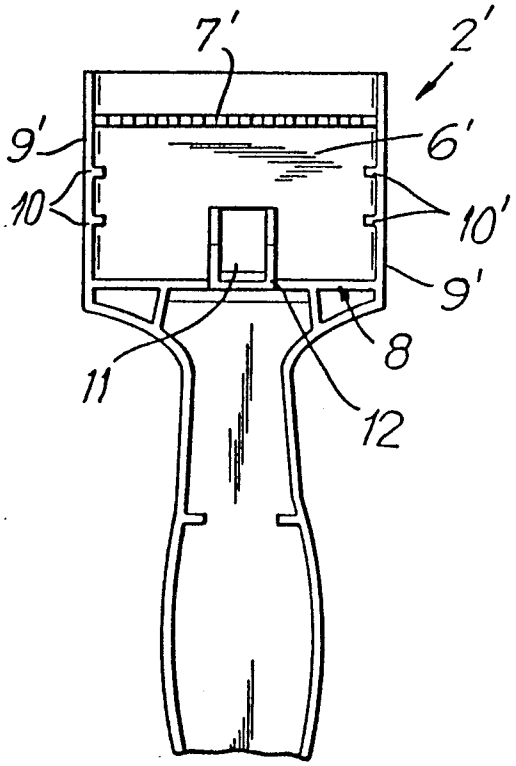
FIG. 2 is a plan view of the female half and FIG. 3 a plan view of the male half of handle of the embodiment shown in FIG. 1.

The half 2', which we have called female (FIG. 2) of the handle, has the receptable 6' bounded by the partition 7' with a serrated edge, in its anterior side; by the posterior partition 8, and by the lateral walls 9' which carry guide means 10 and 10'. At the posterior side, receptable 6' is provided with a rectangular opening 11, surrounded from behind and laterally by projecting member 12, which serves to anchor retention ringlet 5.

In the embodiments presented here the projecting member 12 is an incomplete prism without bases which is open towards the front side of the handle 2. The edges of the walls of this incomplete prism are inclined upwards toward the front side of the handle (when the female half is above the male half of the handle 2). This is what is meant in the following claims by the incomplete prism 12 being "tapered forwards upwards". Also in these embodiments the guide means 10 and 10′ are parallel strips.

Figure 1:
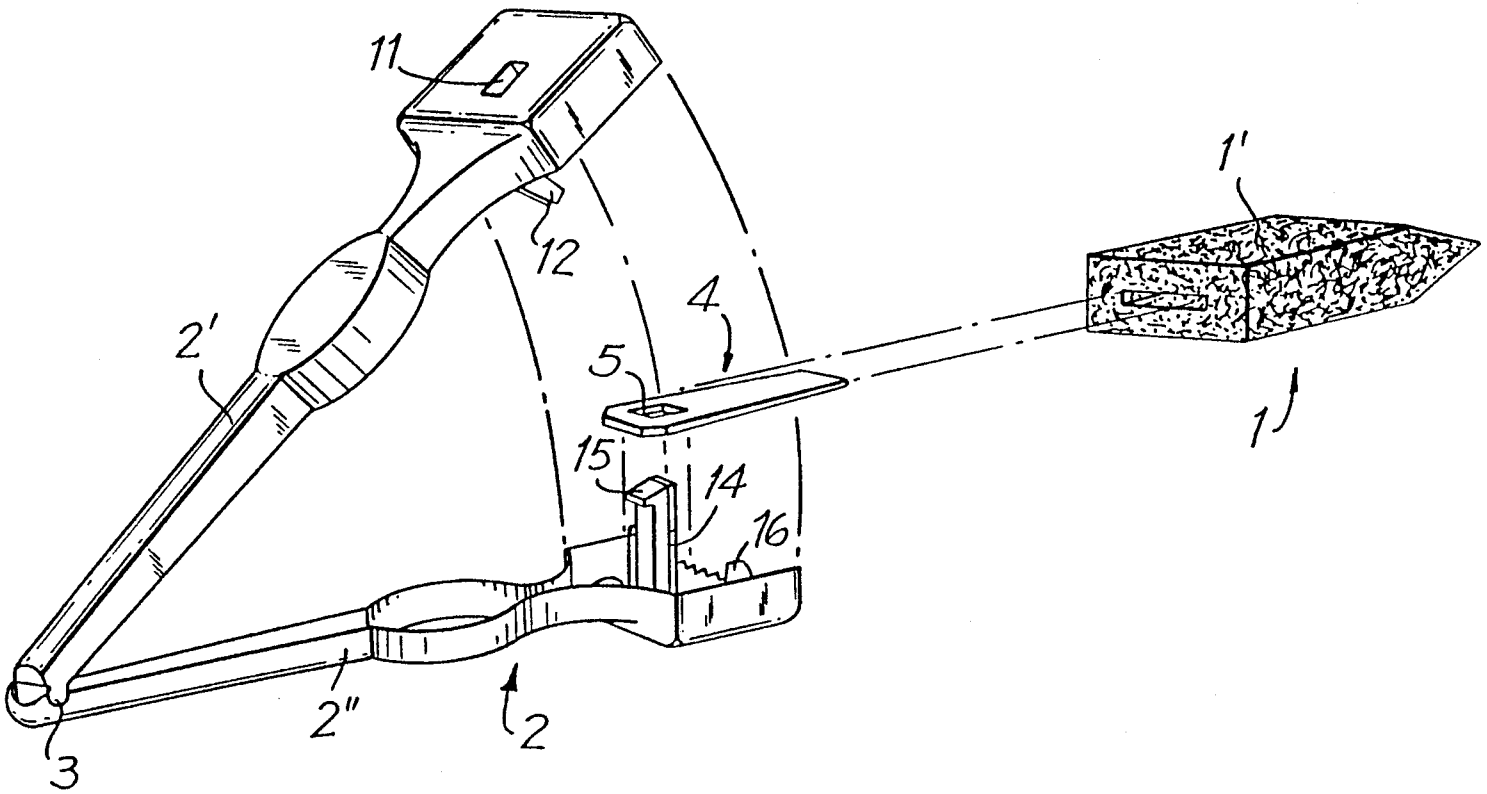
FIG. 1 is an exploded perspective veiw of a first embodiment new paint brush, seen laterally.
Figure 3:
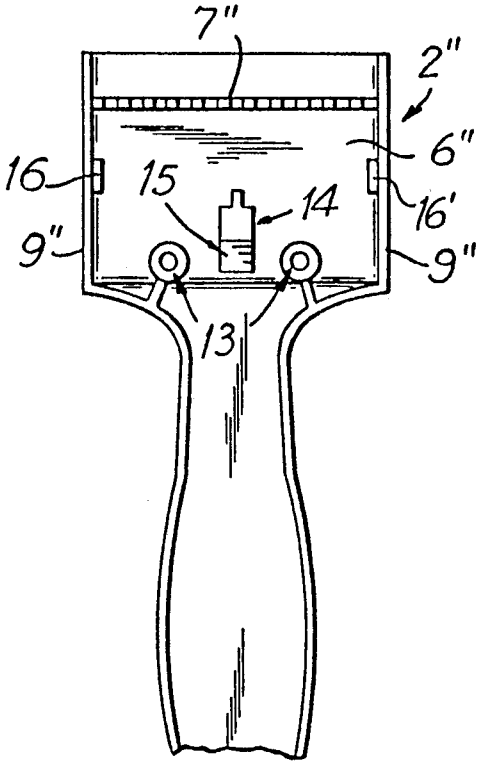

The half 2″, which we have called male, of the handle (FIG. 3), also is provided with the receptacle 6″ bounded by partition 7″ with the serrated edge, at its anterior (or front) side, and by lateral walls 9″. The male half has a stem 14 provided with a nose 15 which arises from the bottom of receptacle 6″ and when the handle 2 is closed, passes through the rectangular opening 11 and the projecting member 12 so that its nose 15 remains hooked on to the outer surface of female half 2′ of the handle.

The male half 2″ also presents two guide lugs 16 and 16′, which cooperate with the guide strips 10 and 10′ of the female half 2′ and besides, two support abutments 13 which cooperate with the back partition 8 of the receptacle 6′ of the female half 2′, the abutments 13 and partition 8 acting as support for the retention ringlet 5.

Figure 4:
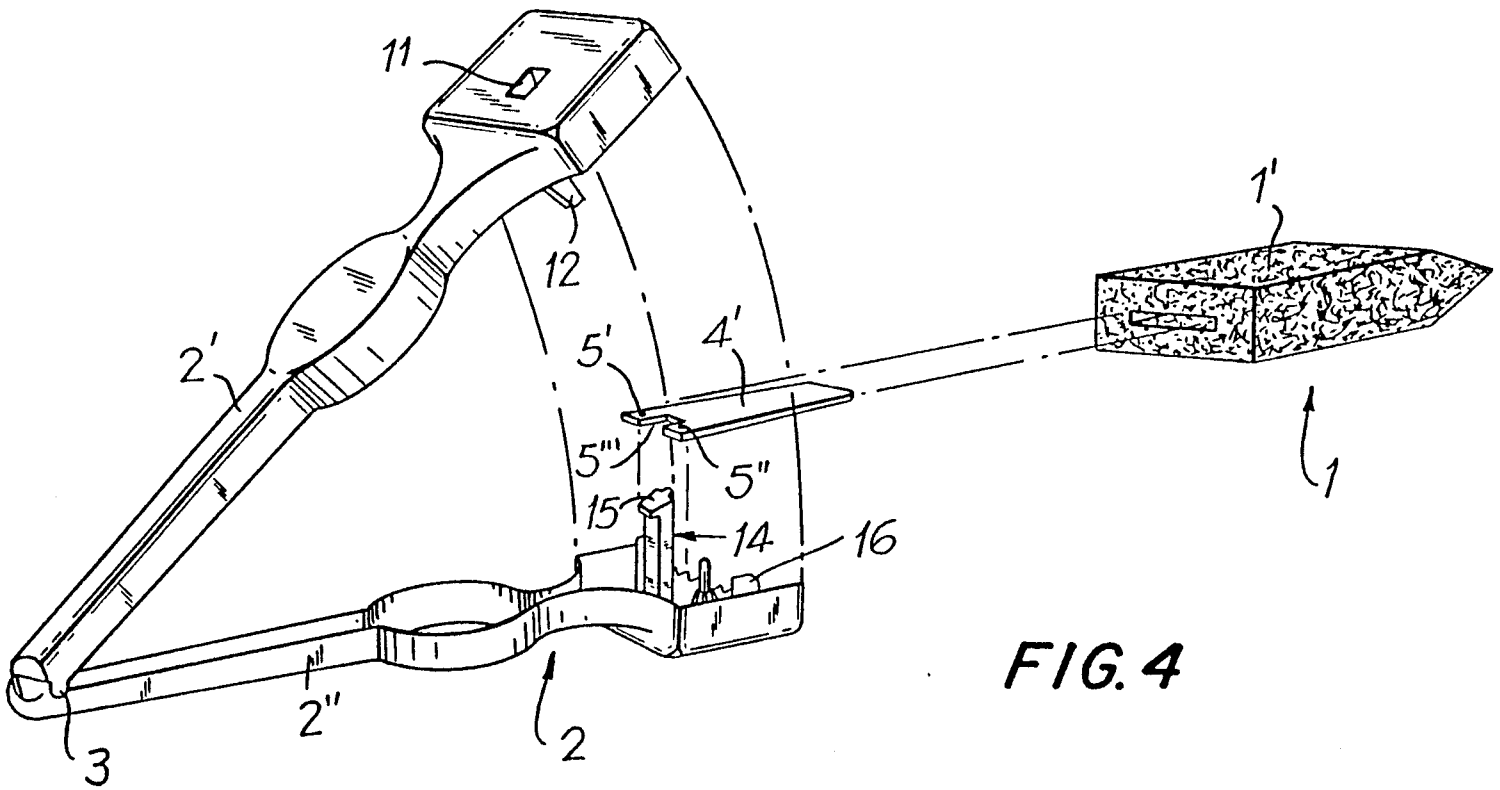
FIG. 4 is unexploded perspective view of a second embodiment of the new paint brush, seen laterally.

FIG. 4 shows a second embodiment, in which like parts of the first embodiment are assigned with like numbers.

In this example, insert 4′ extended from the prismatic body 1′ with two retention ringlets 5′ and 5″, which surround recess 5′ "on both sides, wherein the projecting member or incomplete prism 12 penetrates.

Figure 6A:
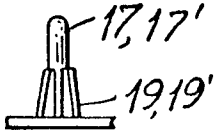
FIG. 6A is a view as seen along arrow A of ringlet support stems shown in FIG. 6.
Figure 6:
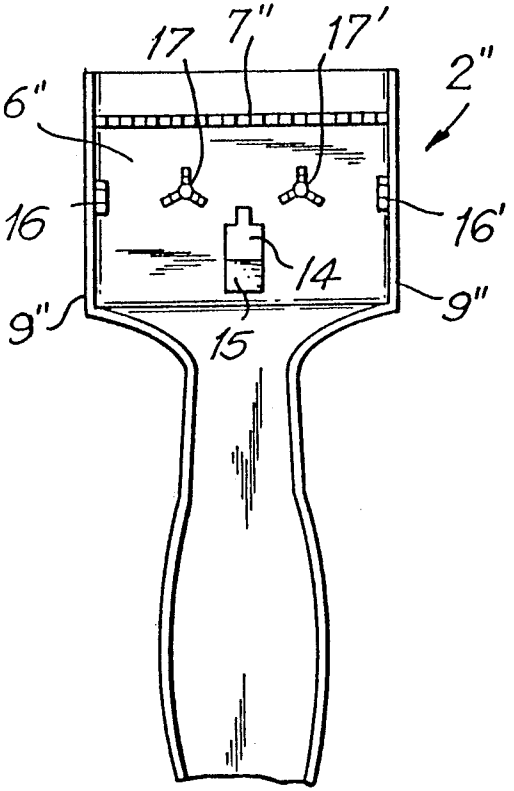
FIG. 5 is a plan view of the female half and FIG. 6 is a plan view of the male half of a handle of the second embodiment shown in FIG. 4.
Figure 5:
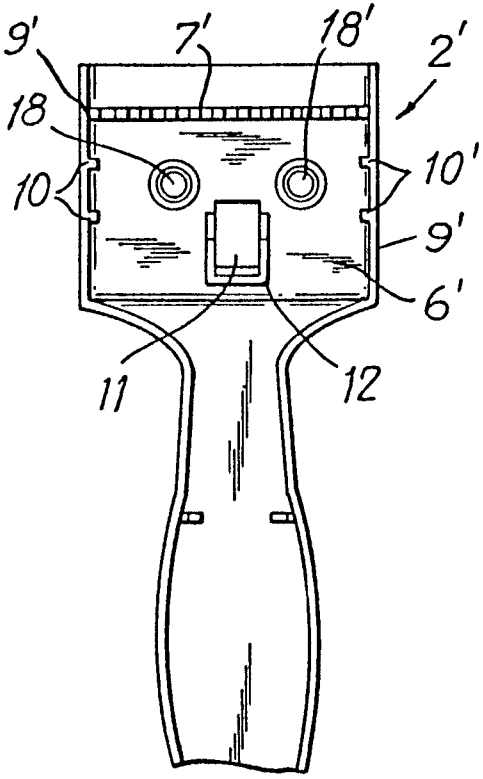

On the other hand, in the receptacles at both halves of the handle (FIGS. 5 and 6), there are the modified support means of the ringlets which, in turn, in this case constitute the anchorage means of these latter. To this end, there have been foreseen emerging from the central or middle part of the receptacle of the male half 2″ (FIG. 6), two prongs 17 and 17′ which cooperate with corresponding hollow protrusions 18 and 18′ provided in the receptacle of the female half 2′ (FIG. 5) of the handle. Prongs 17 and 17′ have corresponding socles 19 and 19′ which, together with protrusions 18 and 18′ already mentioned, constitute the support means of ringlets 5′ and 5″.

It will be understood that each of the elements described above, or two or more together, may also find a useful application in other types of constructions differing from the types described above.

While the invention has been illustrated and described as embodied in a paint brush with a replaceable applicator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

I claim:

1. A paint brush comprising a handle with a male half and a female half, said halves being provided with housing receptacles and with a plurality of lateral walls and, on a front side of said handle, with corresponding partitions with serrated edges of smaller height than said lateral walls and with support and anchorage means, said housing receptacles being bounded by said partitions and said lateral walls for a secured end of said applicator part; a projecting member open towards said front side and protruding from a bottom of said housing receptacle of said female half, said bottom of said housing receptacle having an opening adjacent said projecting member; guide means provided on said lateral walls of said female half perpendicular to said bottom; and a stem with a hook-like nose on a free end thereof projecting substantially perpendicularly from said male half corresponding to said projecting member of said female half; and a replaceable applicator part with at least one retention ringlet engaged and held by said support and a anchorage means, said at least one retention ringlet being inserted in said handle and said male half and said female half being hinged at an end opposite said applicator part, said lateral walls of said male half having a plurality of guide lugs which cooperate with said guide means of said female half so that, when said handle is closed, said hook-like nose passes by and adjacent said projecting member and through said opening in said female half to hold said female half.

2. A paint brush according to claim 1 in which said projecting member has a partially prismatic shape defining an opening facing said front side of said handle.

3. A paint brush according to claim 1 in which said applicator part comprises a prismatic body of foam material.

4. A paint brush according to claim 3 further comprising an insert shaped like a wedge inserted in said prismatic body of said foam material.

5. A paint brush according to claim 1 further comprising an insert for said replaceable applicator part, said insert having one of said retention ringlets engagable with said projecting member of said female half of said handle.

6. A paint brush according to claim 1 further comprising an insert having two retention ringlets positioned on opposite sides of said projecting member and engagable on corresponding prongs projecting from said male half of said handle cooperating with corresponding hollow projections protruding from said female half of said handle.

7. A paint brush according to claim 1 in which said guide means on said lateral walls of said female half of said handle comprise corresponding parallel strips.

8. A paint brush according to claim 1 in which said opening is rectangular.

9. A paint brush according to claim 2 in which said projecting member tapers forwards upwards.

10. A paint brush according to claim 1 in which said stem is profiled.

* * * * *